US007229245B2

(12) United States Patent
Ellis et al.

(10) Patent No.: US 7,229,245 B2
(45) Date of Patent: Jun. 12, 2007

(54) VANE PLATFORM RAIL CONFIGURATION FOR REDUCED AIRFOIL STRESS

(75) Inventors: Charles A. Ellis, Stuart, FL (US); David Parker, Palm Beach Gardens, FL (US); J. Page Strohl, Tequesta, FL (US); David Medrano, Okeechobee, FL (US)

(73) Assignee: Power Systems Mfg., LLC, Jupiter, FL (US)

( * ) Notice: Subject to any disclaimer, the term of this patent is extended or adjusted under 35 U.S.C. 154(b) by 0 days.

(21) Appl. No.: 10/891,400

(22) Filed: Jul. 14, 2004

(65) Prior Publication Data

US 2006/0013685 A1 Jan. 19, 2006

(51) Int. Cl.
*F01D 9/04* (2006.01)

(52) U.S. Cl. ..... 415/135; 415/138; 415/139

(58) Field of Classification Search ..... 415/134–136, 415/138–139, 189–191, 208.2, 209.2, 209.3, 415/209.4, 210.1
See application file for complete search history.

(56) References Cited

U.S. PATENT DOCUMENTS 2,997,275 A * 8/1961 Bean et al. ..... 415/135
3,302,926 A * 2/1967 Bobo ..... 415/209.2
3,781,125 A * 12/1973 Rahaim et al. ..... 415/136
4,017,213 A * 4/1977 Przirembel ..... 416/97 A
4,176,433 A * 12/1979 Lee et al. ..... 415/189
4,194,869 A * 3/1980 Corcokios ..... 415/209.4
4,502,809 A * 3/1985 Geary ..... 415/134
4,720,236 A * 1/1988 Stevens ..... 415/136
4,802,823 A 2/1989 Decko et al.
4,897,021 A * 1/1990 Chaplin et al. ..... 415/139
5,343,694 A * 9/1994 Toborg et al. ..... 415/209.2
6,050,776 A * 4/2000 Akagi et al. ..... 415/209.4
6,494,677 B1 * 12/2002 Grady ..... 415/209.4

FOREIGN PATENT DOCUMENTS

CA 482528 A * 4/1952

* cited by examiner

*Primary Examiner*—Richard A. Edgar
(74) *Attorney, Agent, or Firm*—Shook, Hardy & Bacon LLP

(57) ABSTRACT

A vane assembly for a gas turbine engine is disclosed having lower thermally induced stresses resulting in improved component durability. The stresses in the vane assembly airfoils are lowered by increasing the flexibility of the vane platform and reducing their resistance to thermal deflection. This is accomplished by placing an opening along the vane assembly rail that reduces the effective stiffness of the platform, thereby lowering the operating stresses in the airfoils of the vane assembly. A removable seal is then placed in the opening in order to prevent undesired leakages, while maintaining the benefit of the increased platform flexibility.

2 Claims, 6 Drawing Sheets

FIG. 1 – Prior Art

VANE PLATFORM RAIL CONFIGURATION FOR REDUCED AIRFOIL STRESS

TECHNICAL FIELD

The present invention relates generally to gas turbine engines and more specifically to a turbine vane configuration having reduced airfoil stresses.

BACKGROUND OF THE INVENTION

A gas turbine engine typically comprises a multi-stage compressor, which compresses air drawn into the engine to a higher pressure and temperature. A majority of this air passes to the combustors, which mix the compressed heated air with fuel and contain the resulting reaction that generates the hot combustion gases. These gases then pass through a multi-stage turbine, which, in turn drives the compressor, before exiting the engine. A portion of the compressed air from the compressor bypasses the combustors and is used to cool the turbine blades and vanes that are continuously exposed to the hot gases of the combustors. In land-based gas turbines, the turbine is also coupled to a generator for generating electricity.

Turbines are typically comprised of alternating rows of rotating and stationary airfoils. The stationary airfoils, or vanes, direct the flow of hot combustion gases onto the subsequent row of rotating airfoils, or blades, at the proper orientation such as to maximize the output of the turbine. As a result of the hot combustion gases passing through the vanes, the vanes operate at a very high temperature, typically beyond the capability of the material from which they are made. In order to lower the operating temperatures of the vane material to a more acceptable level, vanes are often cooled, either by air or steam. Typically, turbine vanes are configured in multiple segments, with each segment including a plurality of vanes. This configuration is well known in order to minimize hot gas leakage between adjacent vanes, thereby lowering turbine performance. While this configuration is advantageous from a leakage perspective, it has inherent disadvantages as well, including an increased stiffness along the platform that connects the adjacent vanes, relative to a single vane configuration.

A vane assembly 10 of the prior art, is shown in FIG. 1, and comprises an inner platform 11, inner rail 12, outer platform 13, and vanes 14 extending between inner platform 11 and outer platform 13. While the inner rail serves as a means to seal the rim cavity region from cooling air leaking into the hot gas path instead of passing to the designated vanes, inner rail 12 also stiffens inner platform 11. Inner rails 12, which can be rather large in size, are located proximate the plenum of cooling air and are therefore operating at approximately the temperature of the cooling air. As a result, hot combustion gases passing around vanes 14 and between inner platform 11 and outer platform 13 cause the vanes and platforms to operate at an elevated temperature relative to the inner rail. This sharp contrast in operating temperatures creates regions of high thermally induced stresses in vanes 14 and along inner platform 11 that has been known to cause cracking of the vane assembly requiring premature repair or replacement.

What is needed is a vane assembly configuration that lowers the operating stresses in the vane and inner platform for a vane assembly having an inner rail portion that is exposed to lower operating temperatures than the platform or vane.

SUMMARY AND OBJECTS OF THE INVENTION

A turbine vane assembly is disclosed having lower thermally induced stresses in the airfoil and platform region resulting in improved component durability. The vane assembly comprises an inner arc-shaped platform, an outer arc-shaped platform positioned radially outward of the inner platform, and at least one airfoil extending therebetween. The source of cracking in prior art vane assemblies related to the significant temperature differences over a short distance between the vane, platform, and inner rail, located along the inner platform, opposite to the airfoil. In the present invention, the inner arc-shaped platform further comprises an inner rail having a rail length, a rail height, a rail thickness, an inner rail wall, and at least one opening extending from the inner rail wall and through the rail thickness. The at least one opening is sized to allow the inner arc-shaped platform to have reduced resistance to thermal deflections while not compromising the structural integrity of the inner arc-shaped platform nor allowing leakage of vane cooling fluid. Multiple embodiments of opening geometry are disclosed depending on stress reduction requirements and platform/inner rail geometry.

It is an object of the present invention to provide a turbine vane assembly having reduced thermal stresses in the airfoil and platform regions.

It is another object of the present invention to provide a turbine vane assembly having increased flexibility along the inner platform region.

In accordance with these and other objects, which will become apparent hereinafter, the instant invention will now be described with particular reference to the accompanying drawings.

DETAILED DESCRIPTION OF THE PREFERRED EMBODIMENT

Figure 1:
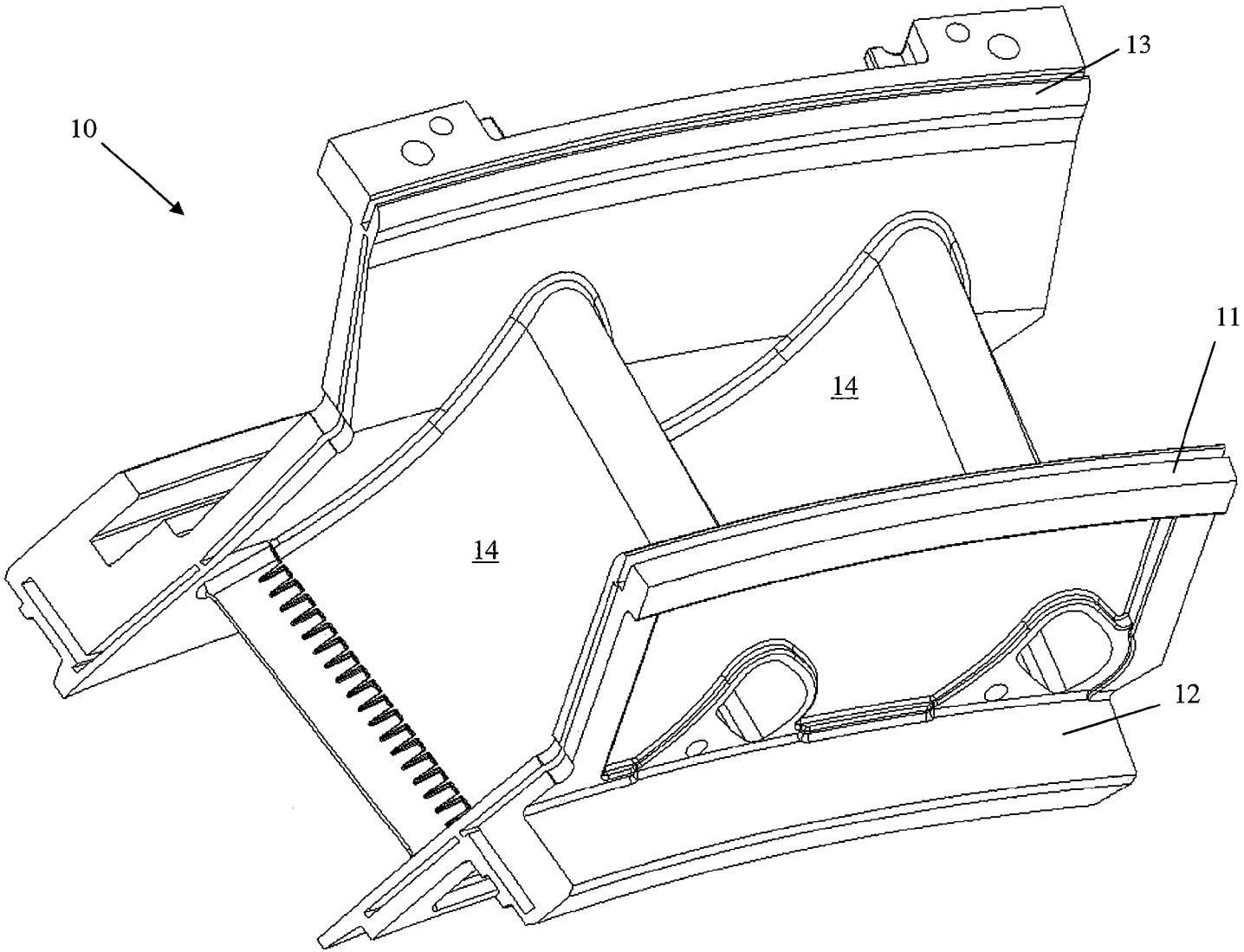
FIG. 1 is a perspective view of a turbine vane assembly of the prior art.
Figure 2:
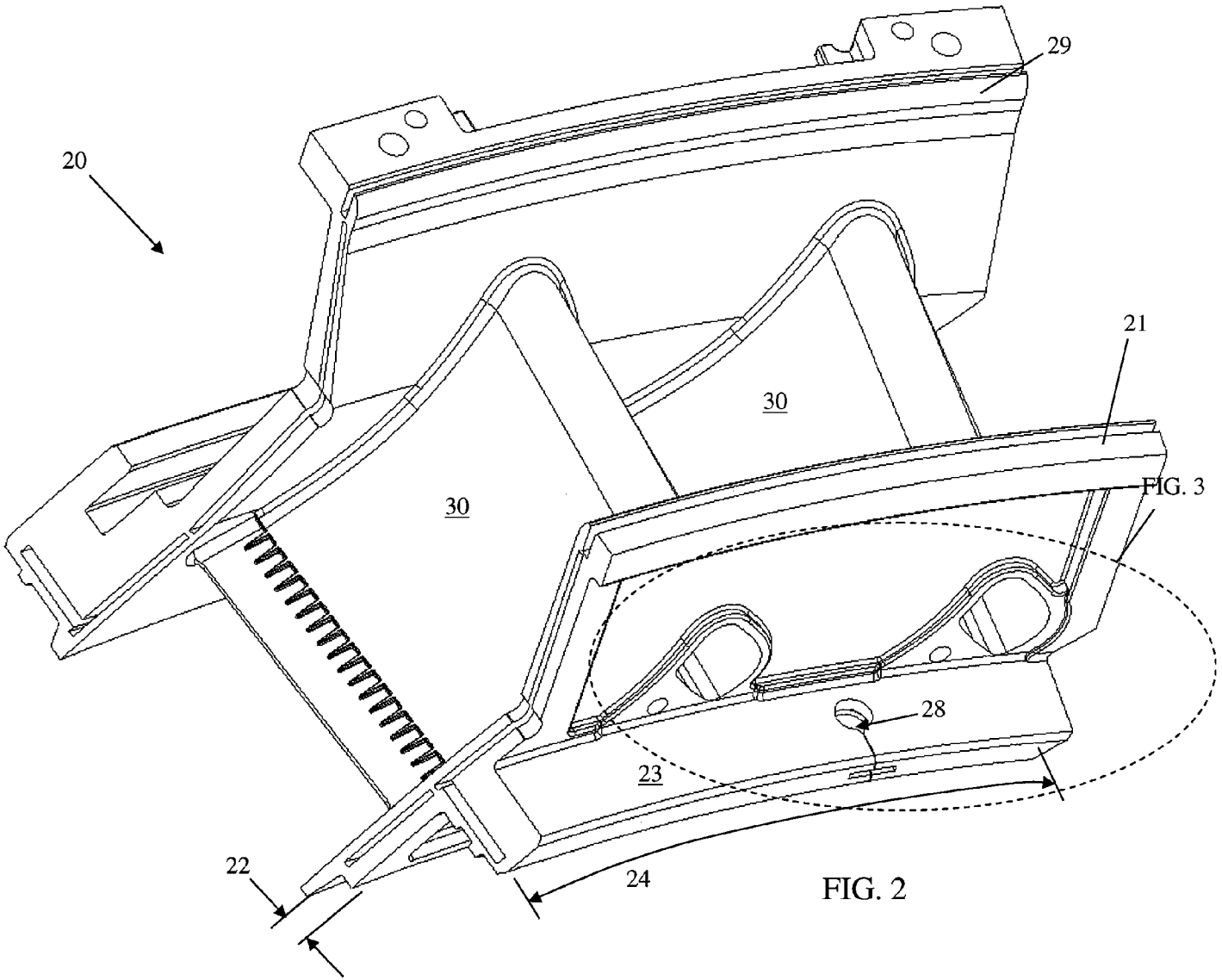
FIG. 2 is a perspective view of a turbine vane assembly in accordance with the preferred embodiment of the present invention.

The present invention is shown in detail in FIGS. 2-6. Referring now to FIG. 2, a vane assembly for a gas turbine engine in accordance with the preferred embodiment of the present invention is shown. Vane assembly 20 comprises an inner arc-shaped platform 21 having a first thickness 22 and an inner rail 23 extending generally circumferentially along inner arc-shaped platform 21. Inner rail 23, which is shown in greater detail in FIGS.2-4, further comprises a rail length 24, a rail height 25, a rail thickness 26, an inner rail wall 27, and at least one opening 28 that extends from inner rail wall 27 and through rail thickness 26. The specific dimensions of rail length 24, rail height 25, and rail thickness 26 can vary depending on the turbine vane configuration and location in the engine. The vane assembly further comprises an outer arc-shaped platform 29 that is positioned radially outward of inner arc-shaped platform 21 and fixed to an airfoil 30 that extends from inner arc-shaped platform 21, opposite of inner rail 23. In the 2 embodiment of the present invention, two airfoils are included in vane assembly 20. However, it is important to note that the present invention can be applied to a vane assembly having fewer or greater number of airfoils 30.

Figure 3:
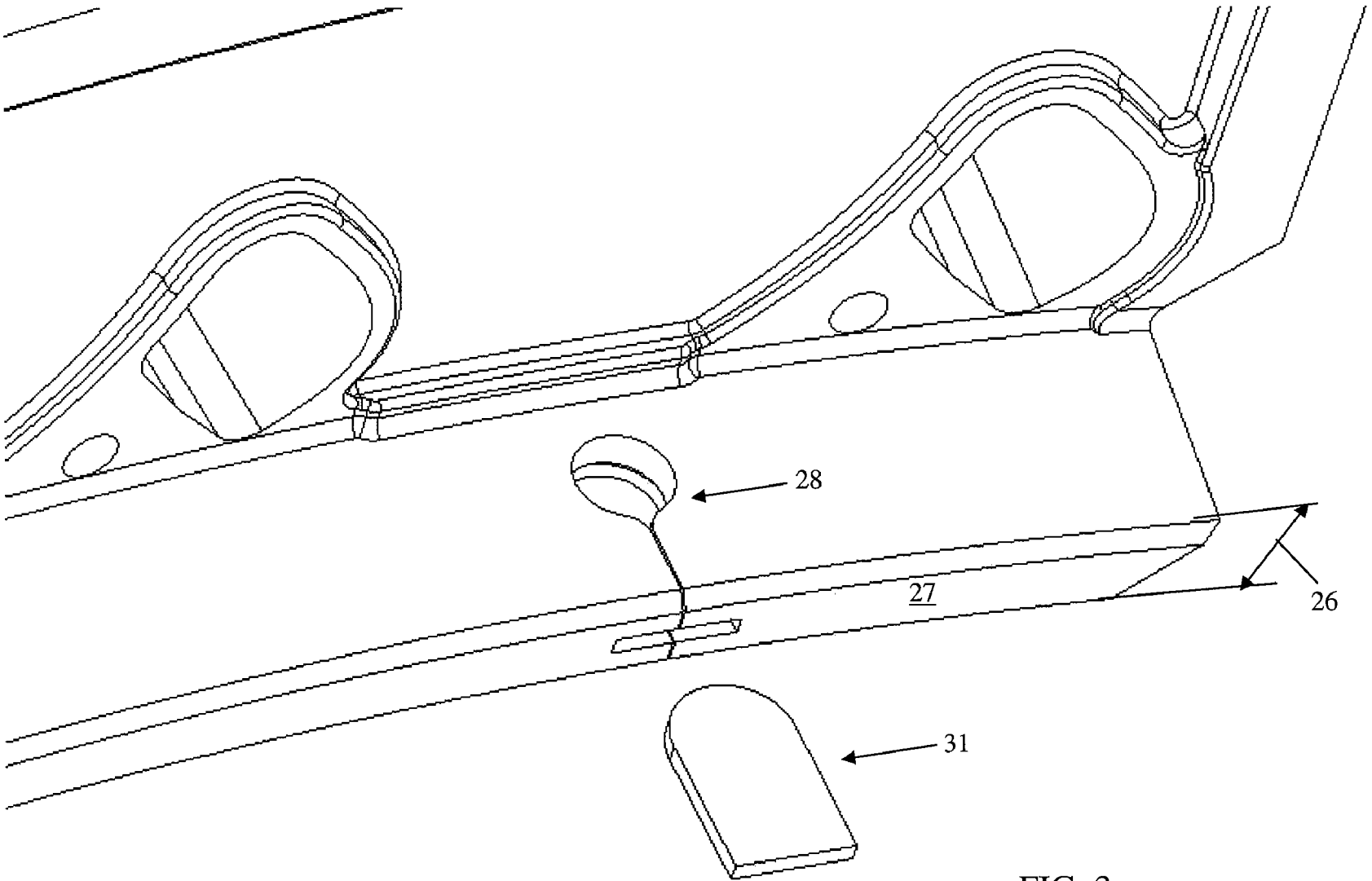
FIG. 3 is a detailed perspective view of a portion of a turbine vane assembly in accordance with the 1 embodiment of the present invention.
Figure 4:
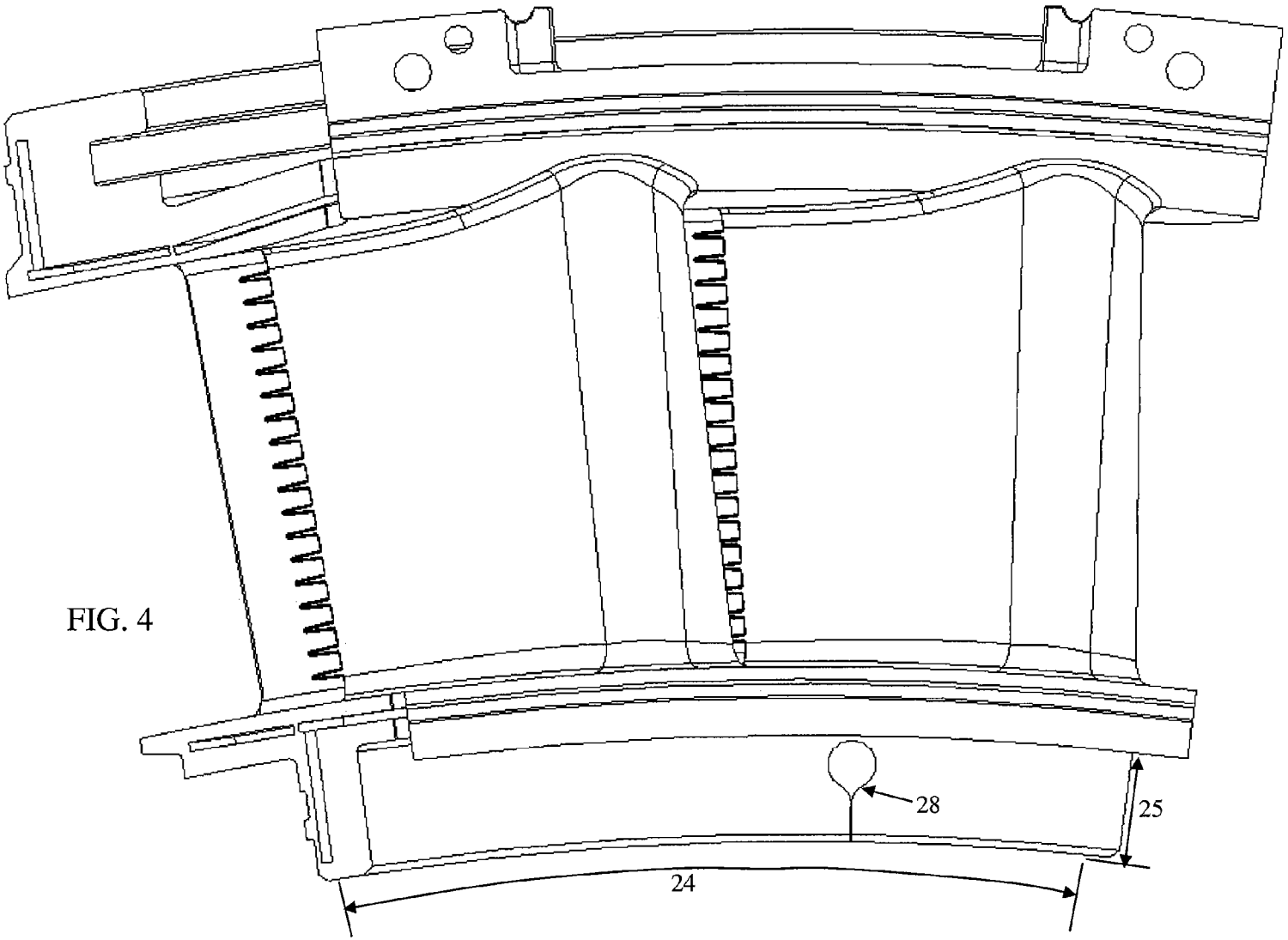
FIG. 4 is an end view of a portion of a turbine vane assembly in accordance with the preferred embodiment of the present invention.

The focus of the present invention is directed towards the inner rail and at least one opening located therein, such that the stress relief provided to inner rail 23 by opening 28 could be applied to a variety of vane assemblies and is not limited to the embodiment disclosed. Opening 28 is configured to allow inner platform 21 to have increased flexibility while not compromising the structural integrity of inner platform 21. For example, in the preferred embodiment of the present invention, opening 28 comprises a slot having a generally circular end, as shown in FIGS. 2-4. This opening configuration reduces the platform effective stiffness thereby increasing platform flexibility and reducing the resistance to thermal deflections imposed by a multiple airfoil vane assembly. Reducing the resistance to thermal deflections allows inner platform 21 to relax and bend, thereby releasing the thermal stresses found in the inner platform and vane due to the differing thermal gradients between airfoils 30 and inner platform 21. For the particular embodiment shown in FIGS. 2-4, the configuration of opening 28 resulted in approximately 14% reduction in airfoil stresses. The quantity of openings 28, their respective location along inner rail 23, and their respective configuration depends on the stress levels of the vane assembly configuration, which in turn is a function of at least the quantity of airfoils, aerodynamic shape of the airfoils, operating temperatures, and material composition, etc. For example, opening 28 can be a slot having a generally circular end, as shown in FIGS. 2-4 for the preferred embodiment or it can be a generally U-shaped slot as shown in the alternate embodiment in FIGS. 5 and 6. For either configuration, it is important for opening 28 to include a rounded end such as to not introduce any locations having a concentrated stress that could result in potential crack initiation.

Figure 5:
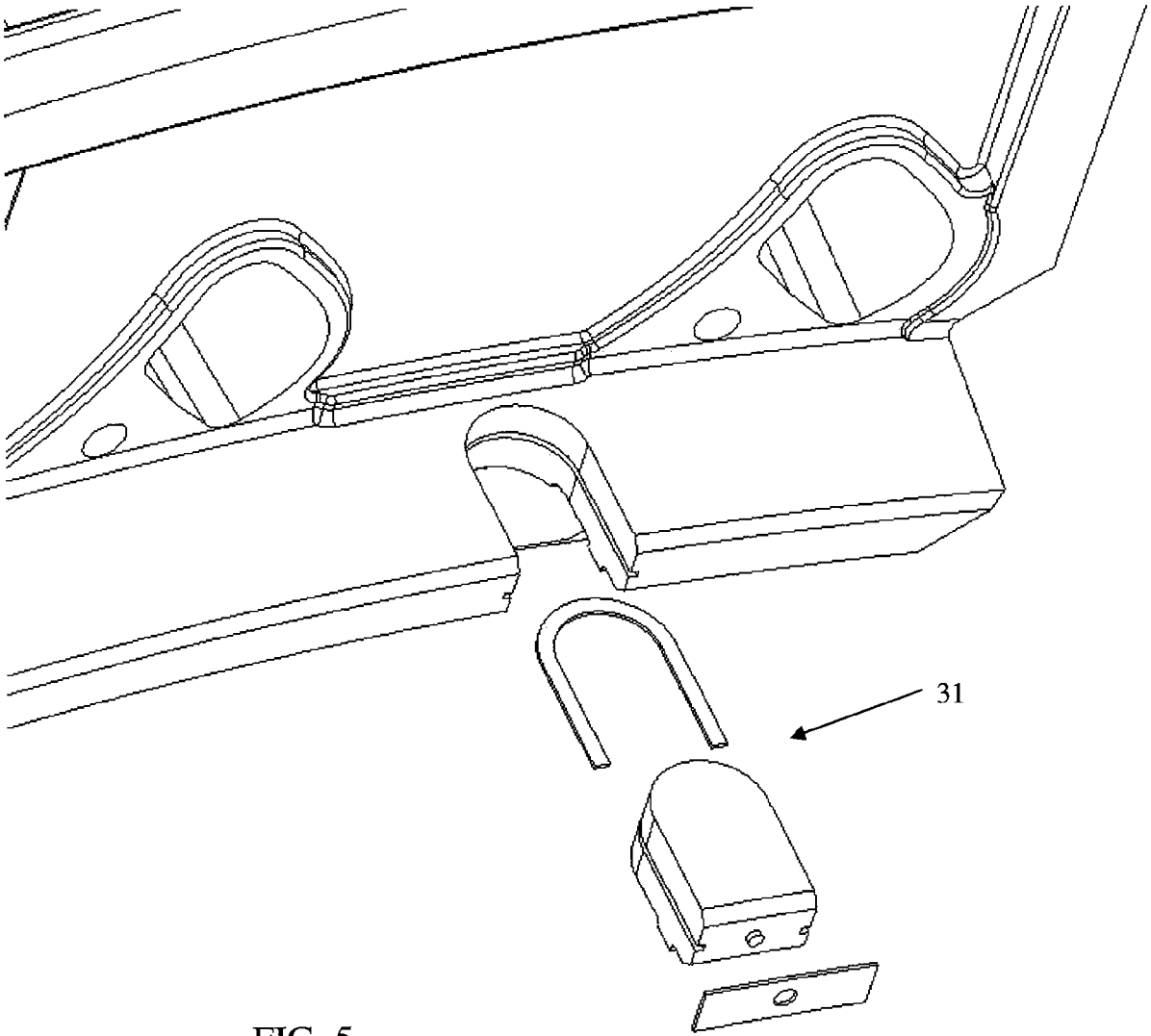
FIG. 5 is a detailed perspective view of a portion of a turbine vane assembly in accordance with an alternate embodiment of the present invention.
Figure 6:
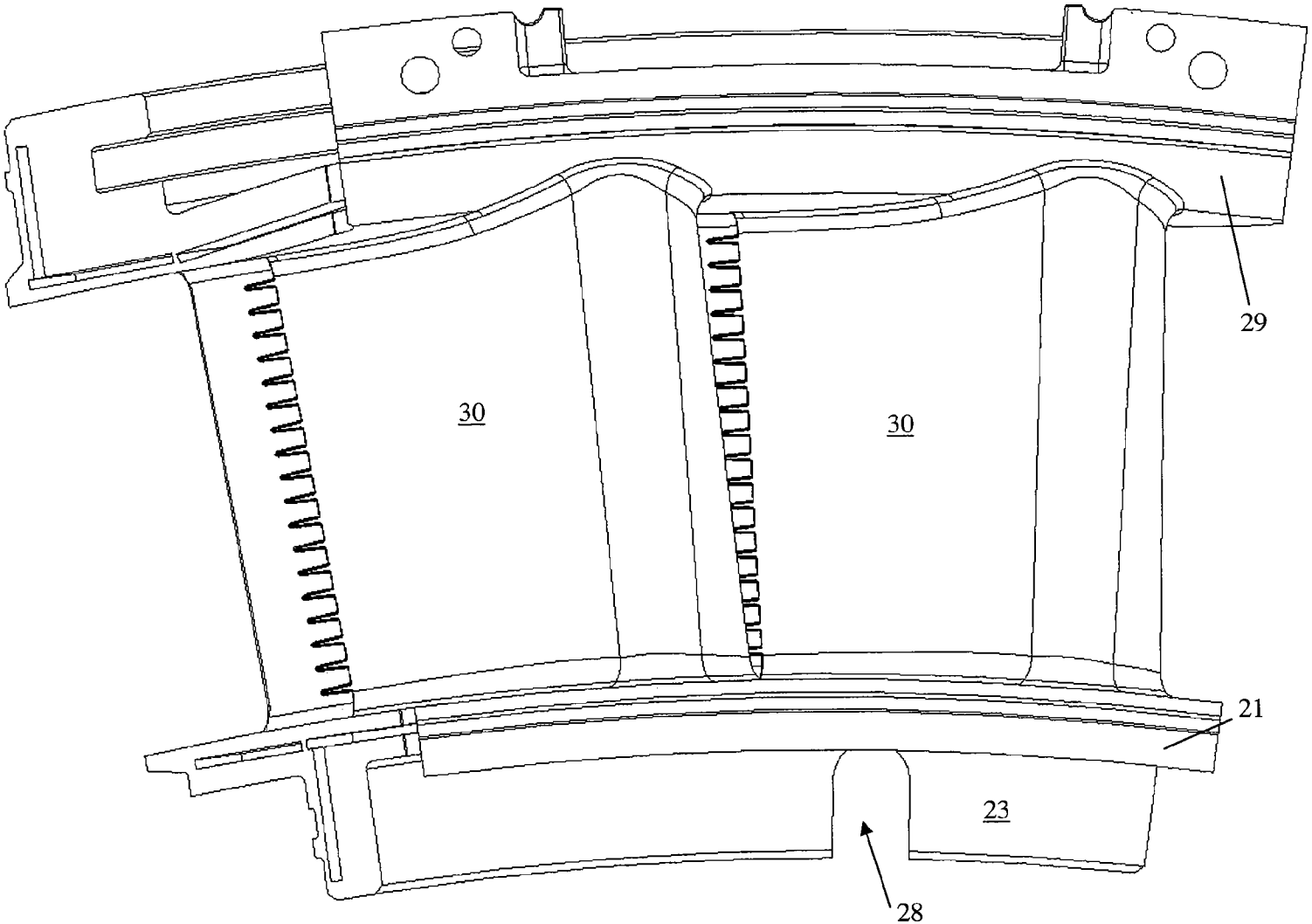
FIG. 6 is an end view of a portion of a turbine vane assembly in accordance with an alternate embodiment of the present invention.

An additional feature of the present invention is a removable seal 31 that is placed within the slot of opening 28 in order to seal inner rail 23 from any leakages of cooling fluid that is dedicated for airfoils 30. Seal 31 is fixed to inner rail 23 by a removable means such as tack welding at one end of the seal, such that the structural freedom intended by opening 28 is maintained. Seal 31, as shown in FIGS. 3 and 5 are dependent upon the configuration of opening 28 and will vary accordingly in order to ensure a sufficient sealing system.

While the invention has been described in what is known as presently the preferred embodiment, it is to be understood that the invention is not to be limited to the disclosed embodiment but, on the contrary, is intended to cover various modifications and equivalent arrangements within the scope of the following claims.

What we claim is:

1. A vane assembly for a gas turbine engine comprising:

an inner platform;

an outer platform spaced radially outward of said inner platform;

an inner rail extending generally circumferentially along said inner platform and radially inward of said inner platform, said inner rail having a rail length, rail height, rail thickness, and an inner rail wall;

at least one generally U-shaped opening extending radially outward from said inner wall toward said inner platform and extending through said thickness;

at least one airfoil extending from said inner platform to said outer platform;

a generally U-shaped seal positioned within said opening such that said seal extends radially inward from said inner rail wall and said seal is removably coupled to said inner rail; and wherein said opening is positioned along said inner rail such that said opening is located radially beneath said at least one airfoil.

2. The vane assembly of claim 1 wherein said seal has a rounded end corresponding to said generally U-shaped opening.

* * * * *